US007754026B2

(12) United States Patent
Kehl

(10) Patent No.: US 7,754,026 B2
(45) Date of Patent: Jul. 13, 2010

(54) DISHWASHER WITH SONIC CLEANER

(75) Inventor: Dennis L. Kehl, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/937,065

(22) Filed: Nov. 8, 2007

(65) Prior Publication Data

US 2009/0120474 A1 May 14, 2009

(51) Int. Cl.
*A47L 15/13* (2006.01)
*A47L 15/22* (2006.01)

(52) U.S. Cl. ..... 134/58 D; 134/56 D; 134/57 D; 134/172; 134/184; 134/191

(58) Field of Classification Search ..... 134/58 D, 134/191, 172, 184, 57 D, 56 D
See application file for complete search history.

(56) References Cited

U.S. PATENT DOCUMENTS 2,980,123 A 4/1961 Lemelson
2,985,003 A * 5/1961 Gelfand et al. ..... 68/3 R
3,582,733 A 6/1971 Brubaker
3,854,998 A * 12/1974 Jacobs ..... 134/191
3,923,073 A * 12/1975 Jacobs ..... 134/57 D
4,998,549 A * 3/1991 Bran ..... 134/184
5,906,687 A 5/1999 Masui et al.
6,624,133 B1 9/2003 McKenzie et al.
6,689,730 B2 2/2004 Hortel et al.
7,004,182 B2 2/2006 Duval et al.
2004/0250837 A1 * 12/2004 Watson et al. ..... 134/25.2
2005/0081895 A1 * 4/2005 Miyauchi et al. ..... 134/58 D
2005/0103364 A1 * 5/2005 Kamikawa ..... 134/57 R
2005/0252540 A1 * 11/2005 Ooe ..... 134/184

FOREIGN PATENT DOCUMENTS

DE 3904423 A1 8/1990
EP 0691101 A1 1/1996
FR 2846865 5/2004
JP 11047061 2/1999
JP 2000325282 11/2000

* cited by examiner

*Primary Examiner*—Joseph L Perrin
*Assistant Examiner*—Benjamin Osterhout
(74) *Attorney, Agent, or Firm*—John W. Morrison; McGarry Bair PC

(57) ABSTRACT

A household dishwasher having a sonic cleaner that propagates sonic waves via a stream of liquid to clean off a utensil.

13 Claims, 3 Drawing Sheets

DISHWASHER WITH SONIC CLEANER

BACKGROUND OF THE INVENTION

Dishwashers using ultrasonic cleaning, while effective at cleaning, have not had great commercial success because their cleaning effect is dependent upon the transfer of the ultrasonic energy to the item being cleaned. Prior ultrasonic dishwashers relied on a liquid bath in which the utensil was submerged to ensure transmission of the ultrasonic waves through the liquid medium to the utensil. The immersion bath is not commercially viable because of the large volume of liquid required. Recontamination from the cleaning liquid is also a problem that may be encountered with traditional sonic methods.

SUMMARY OF THE INVENTION

The invention relates to a household dishwasher having a wash chamber for receiving utensils to be washed, and comprising a sonic cleaner having a stream generator for directing a stream of liquid into the chamber and a transducer for generating sound waves that propagate along the stream of liquid. A second embodiment, provides a household dishwasher having a wash chamber for receiving utensils to be washed, and comprising a sonic cleaner for directing a liquid propagation medium into the chamber and propagating sonic waves via the liquid propagation medium wherein the liquid propagation medium defines a first wash zone within the wash chamber. A third embodiment, provides a household dishwasher comprising a sonic cleaner for directing a liquid propagation medium into a wash chamber and propagating sonic waves via the liquid propagation medium wherein the liquid propagation medium is a sheet of liquid that forms a line of liquid at the intersection of a utensil being cleaner to form a linear cleaning front.

DESCRIPTION OF EMBODIMENTS OF THE INVENTION

Figure 1:
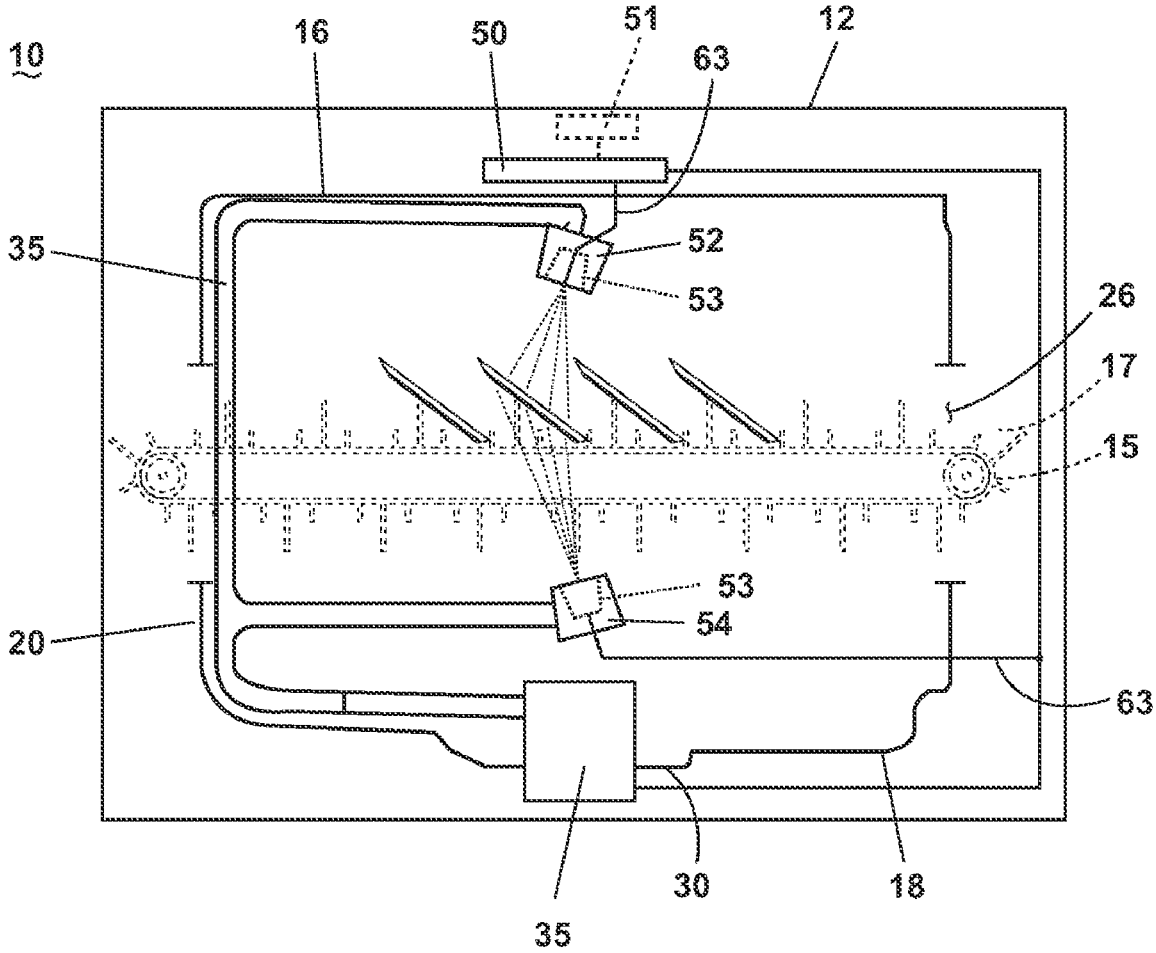
FIG. 1 is a schematic view of a dishwasher according to the invention with wash chamber, conveyor belt, pump and a sonic cleaner assembly.

Referring now to FIG. 1 an embodiment of the invention is illustrated comprising an automated dishwasher 10 having a housing 12. The dishwasher 10 shares many features of a conventional automated dishwasher, which will not be described in detail herein except as necessary for a complete understanding of the invention. The housing 12 has spaced top and bottom walls 16 and 18, and spaced side walls 20. The walls 16, 18, and 20 join along their respective edges to define a wash chamber 24.

A utensil holder in the form of a conveyor belt 15 with utensil rack 17 (both shown in phantom) is located within the wash chamber 24 and receive utensils for washing. The side walls 20 have open portions 26, which act as a door on either side of the wash chamber 24, for providing accessibility to the wash chamber 24 and provide for an area for the conveyor belt

15 to run. As used in this description, the term utensil is generic to dishes and the like that are washed in the dishwasher 10 and expressly includes, dishes, plates, bowls, silverware, glassware, stemware, pots, pans, and the like.

The bottom wall 18 of the dishwasher may be sloped to define a lower tub region or sump 30 of the tub. A pump assembly 35 with a filter may be located in or around a portion of the bottom wall 18 and in fluid communication with the sump 30 to draw wash liquid from the sump 30 and to pump the liquid to at least one upper sonic cleaner assembly 52. If the dishwasher 10 has a lower sonic cleaner assembly 54 liquid may be selectively pumped through a supply tube 35 to each of the assemblies for selective washing. The pump assembly 35, sonic cleaner assemblies 52 and 54, and supply tube 35 collectively form a liquid recirculation system for liquid streams within the wash chamber 24. The pump assembly 35 draws liquid from the sump 30 and delivers it to one or more of the sonic cleaner assemblies 52 and 54 through the supply tube 35, where the liquid is directed back into the wash chamber 24 through the sonic cleaner assemblies 52 and 54 and drains back to the sump 30 where the process is repeated.

A controller 50 is operably coupled to the pump assembly 35 and sonic cleaner assemblies 52 and 54 and controls the operation of the pump assembly 35 and sonic cleaner assemblies 52 and 54 to implement the selected cycle. The controller 50 may comprise a user interface enabling the user to select the desired wash cycle and set correspondingly relevant parameters or options for the cycle. A control panel 51, shown in phantom, may be coupled to the controller 50 and may provide for input/output to/from the controller 50. The control panel may be any suitable input/output device, such as a touch panel, switches, knobs, displays, indicators, etc., and any combination thereof.

In this embodiment, the upper sonic cleaner assembly 52 is positioned above the utensil rack 17 that is located on the conveyor belt 15, the lower sonic cleaner assembly 54 is positioned below the utensil rack 17 that is located on the conveyor belt 15. Each sonic cleaner assembly 52 and 54 is configured to direct a stream of liquid into a sub-portion of the interior of the wash chamber 24 and more specifically onto a sub-portion of the conveyor belt 15. This stream of liquid may be any liquid propagation medium including, water, a liquid wash aid, or a combination thereof. The type of liquid propagation medium used is not germane to the invention. Examples of common wash aids include: a detergent, a spot reducer, a rinse agent, a stain remover, bleach, or any other similar product that facilitates excellent cleaning of the utensils and does not impede sonic wave forms being propagated therein.

The sonic cleaner assemblies 52 and 54 are located in the wash chamber 24 such that at some point during one revolution of the conveyor belt 15 a utensil on the conveyor belt will pass between the sonic cleaner assemblies 52 and 54. The stream of liquid from the sonic cleaner assemblies 52 and 54 is typically directed to wash utensils located in the utensil rack 17 of the conveyor belt 15. While the sonic cleaner assemblies 52 and 54 are illustrated as being located directly above and below the center of the conveyor belt 15, the sonic cleaner assemblies 52 and 54 can be of any configuration and location, including the addition of more sonic cleaner assemblies.

The sonic cleaner assemblies 52 and 54 further comprise a transducer shown schematically and in phantom as 53. While the remainder of this application will illustrate and describe the transducer 53 as a piezoelectric transducer it is contemplated that the transducer 53 may be of any type, structure, and configuration. The transducer 53 converts energy into sonic waves. A piezoelectric crystal in the transducer 53 changes size when a voltage is applied to it by an electrical conduit 63, thus applying an alternating voltage across it will cause it to oscillate at very high frequencies, thus producing very high frequency sound waves. The sound waves may then be propagated via the stream of liquid which the sonic cleaner assemblies 52 and 54 produce. This stream of liquid may also be referred to as a liquid propagation medium.

During operation of the dishwasher 10, the sonic cleaner assemblies 52 and 54 may be employed to direct sonic waves via a stream of liquid propagating medium into the wash chamber 24 under the control of the controller 50. When time comes to direct the stream of liquid into the wash chamber 24, the controller 50 signals the sonic cleaner assemblies 52 and 54 and the pump assembly 35 to supply a stream of liquid from at least one of the sonic cleaner assemblies 52-54, and any accompanying sprayers or conduits, to the wash chamber 24. The controller 50 sends an alternating voltage signal through the electrical conduit 63 to the transducer 53 that in turn creates high frequency sound waves. The sonic waves create very fine vibrations where the stream of liquid propagation medium comes in contact with the utensil. In essence, a cleaning action is transmitted to the utensil via the stream of liquid that is propagating the sonic waveform.

The main mechanism of cleaning action is by energy released from the creation and collapse of microscopic cavitation bubbles, which break up and lift off soil and contaminants from the surface of the utensil. The transducer 53 of the invention may create sonic waves that are in the ultrasonic range, usually from 15-700 kHz, or in the megasonic range, usually from 1000 kHz, depending upon the voltage applied. Sonic waves work by generating controlled acoustic cavitation in the cleaning fluid. The higher the frequency, the smaller the nodes between the cavitation points which allows for more precise cleaning. Cavitation, the formation and activity of bubbles, is an important mechanism in the actual particle removal process, because cavitation has sufficient energy to overcome particle adhesion forces and cause soil particles to be removed from utensils. Controlled megasonic waveforms also push soil particles away from the utensil being cleaned so they do not reattach to the utensil being cleaned.

The difference between ultrasonic cleaning and megasonic cleaning lies in the frequency that is used to generate the acoustic waves. Ultrasonic cleaning uses lower frequencies; it produces random cavitation. Megasonic cleaning uses higher frequencies at 1000 kHz; it produces controlled cavitation. An important distinction between the two methods is that the higher megasonic frequencies do not cause the violent cavitation effects found with ultrasonic frequencies. This significantly reduces or eliminates the likelihood of surface damage to the product being cleaned and allows more delicate objects to be cleaned.

Once the soil particles have been separated from the utensil they will fall off due to gravity or are carried away by the stream of liquid. Thus, recontamination is less of an issue because the stream of liquid flushes soil from the surface after the sonic wave dislodges the soil and a filter in the pump assembly 35 strains soil particles from the re-circulating liquid.

Figure 2:
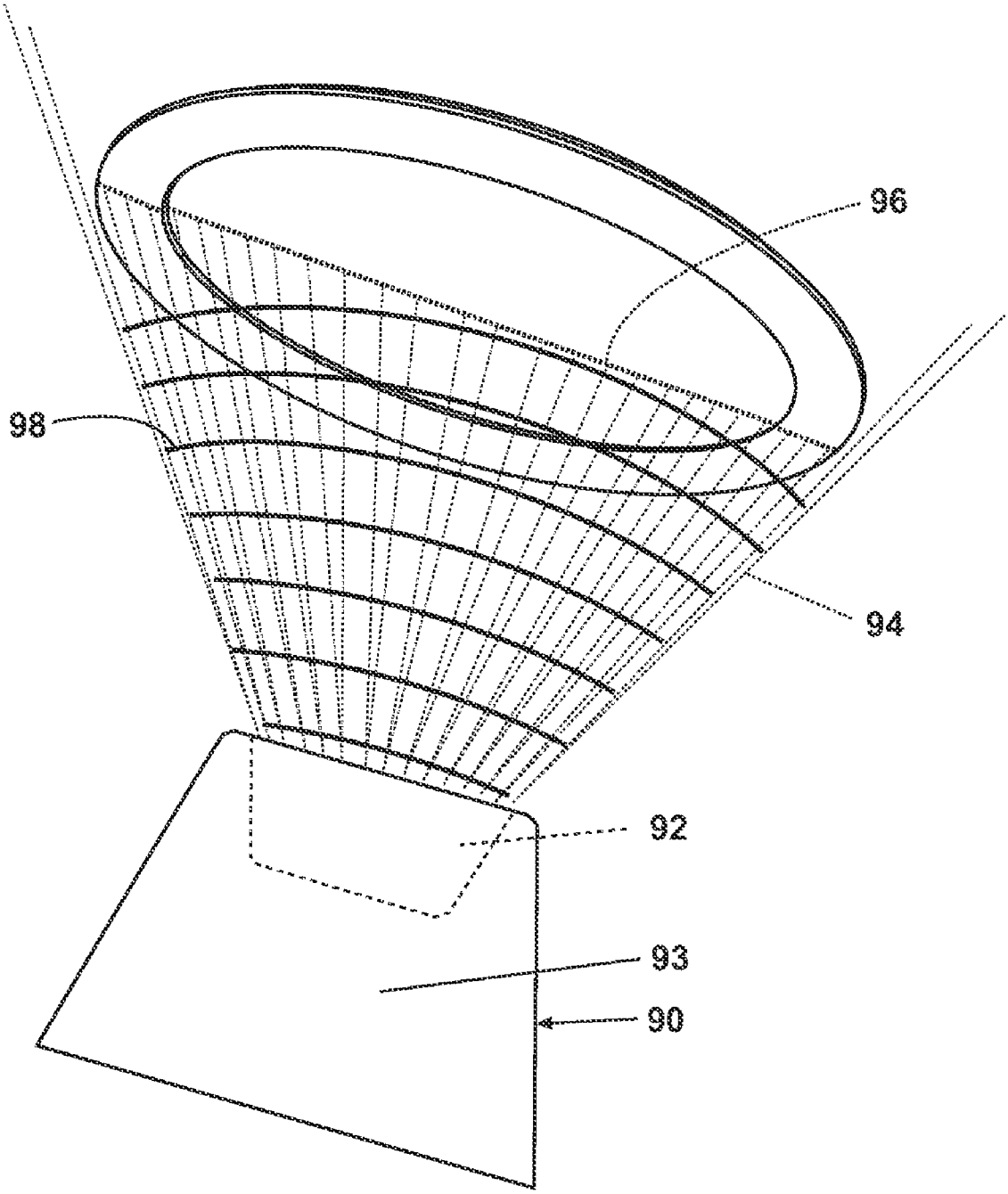
FIG. 2 is a schematic view of the sonic cleaner of the invention.

FIG. 2 is an example of an embodiment of the invention and comprises a sonic cleaner assembly 90. The sonic cleaner assembly 90 comprises a transducer 92 located within a liquid-conducting housing 93 that defines a stream generator through which liquid passes to output a stream of fluid to form the liquid propagation medium 94. The liquid propagation medium is imbedded with ultrasonic or megasonic waveforms 98 as it passes in front of the active transducer 92. The ultrasonic or megasonic waveforms 98 via the liquid propagation medium 94 are projected from the sonic cleaner assembly 90. Upon exiting the sonic cleaner assembly 90 the liquid medium propagating the sonic waves is directed into the wash chamber where the stream may then meet the surface of a utensil. The stream of liquid propagation medium 94 exiting the sonic cleaner assembly 90 may take several forms including that of a sheet or fan shape that forms a line of liquid at the intersection of a utensil being cleaned, to form a linear cleaning front 96.

Figure 3:
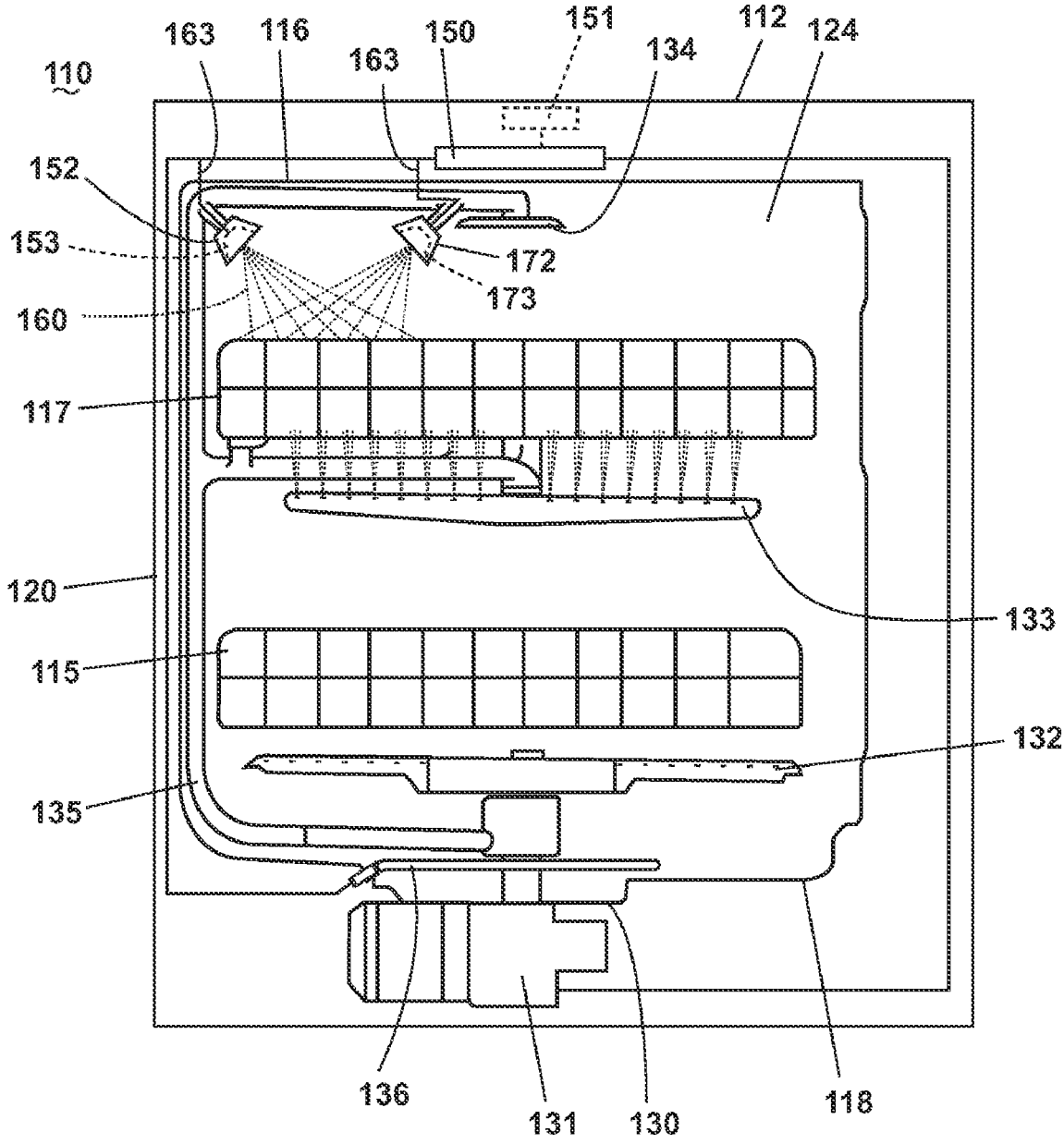
FIG. 3 is a schematic view of a second embodiment of a dishwasher according to the invention with, wash chamber, upper and lower racks and a sonic cleaner assembly.

While the present invention has been described in terms of a conveyor dishwashing unit as illustrated in FIG. 1, it could also be implemented in other types of dishwashing units such as in-sink dishwashers or drawer dishwashers. For example, FIG. 3 is a second embodiment of the invention comprising an automated dishwasher 110 having a housing 112. The dishwasher 110 shares many features of a conventional automated dishwasher, which will not be described in detail herein except as necessary for a complete understanding of the invention.

The housing 112 has spaced top and bottom walls 116 and 118, and spaced side walls 120. The walls 116, 118, and 120 join along their respective edges to define the wash chamber 124. The front wall may be the door of the dishwasher 110, which may be pivotally attached to the dishwasher 10 for providing accessibility to the wash chamber 124 for loading and unloading utensils or other washable items.

Utensil holders in the form of upper and lower racks 115, 117 are located within the wash chamber 124 and receive utensils for washing. The upper and lower utensil racks 115, 117 are typically mounted for slidable movement in and out of the wash chamber 124 for ease of loading and unloading.

The bottom wall 118 of the dishwasher may be sloped to define a lower tub region or sump 130 of the tub. A pump assembly 131 with a filter for straining out soil particles may be located in or around a portion of the bottom wall 118 and in fluid communication with the sump 130 to draw wash liquid from the sump 130 and to pump the liquid to at least a lower spray arm assembly 132. If the dishwasher has a mid-level spray arm assembly 33 and/or an upper spray arm assembly 134, liquid may be selectively pumped through a supply tube 135 to each of the assemblies for selective washing.

In this embodiment, the lower spray arm assembly 132 is positioned beneath a lower utensil rack 115, the mid-level spray arm assembly 133 is positioned between an upper utensil rack 117 and the lower utensil rack 115, and the upper spray arm assembly 134 is positioned above the upper utensil rack 117. The lower spray arm assembly is configured to rotate in the tub and spray a flow of wash liquid, in a generally upward direction, over a sub-portion of the interior of the tub. The spray from the lower spray arm is typically directed to wash utensils located in the lower rack. Like the lower spray arm assembly, the mid-spray arm assembly may also be configured to rotate in the dishwasher 10 and spray a flow of wash liquid, in a generally upward direction, over a portion of the interior of the tub. In this case, the spray from the mid-spray arm assembly is directed to utensils in the upper utensil rack. Typically, the upper spray assembly 34 generally directs a spray of wash liquid in a generally downward direction and helps wash utensils on both utensil racks.

A heater 136 is located within the sump 130 for heating the wash liquid contained in the sump 130. The heater does not need to be used for the sonic cleaning to occur, but may help to sanitize utensils being cleaned. A similar heater may be used in the first embodiment. A controller 150 is operably coupled to the pump assembly 131 and heater 136 and controls the operation of the both to implement the selected cycle. The controller 150 may comprise a user interface enabling the user to select the desired wash cycle and set correspondingly relevant parameters or options for the cycle. A control panel 151, shown in phantom, may be coupled to the controller 150 and may provide for input/output to/from the controller 150. The control panel may be any suitable input/output device, such as a touch panel, switches, knobs, displays, indicators, etc., and any combination thereof.

In this embodiment, a sonic cleaner assembly 152 is located inside the housing 112 of the dishwasher 110. The sonic cleaner assembly 152 may be fixed to the tub of the wash chamber 124 and configured to provide a first flow of wash liquid over a sub-portion, or several portions, of the interior of the wash chamber 124 including at least a portion of one of the upper and lower utensil racks 115 and 117. In essence a stream of wash liquid with sonic waves propagated therein is transferred from at least one sonic cleaner assembly 152 to utensils located in some sub-portion of the wash chamber 124 such as in one of the upper and lower utensil racks 115 and 117. Wash liquid is also sprayed from the rotating spray arm assemblies 132 and 133 and the upper spray arm assembly 134. The stream of liquid from the sonic cleaner assembly 152 may be used to provide liquid to areas outside that provided by the spray arm assemblies 132-134 or to intensify the volume of liquid in one particular area of the wash chamber 124. If the wash liquid from the spray arm assemblies 132-134 and the wash liquid from the sonic cleaner assembly 152 are directed at the same area in the wash chamber 124 the intensified volume of wash liquid may create a zone of intensified wash performance and be used to improve the wash performance of highly soiled utensils. Thus, the wash liquid from the sonic cleaner assembly 152 may create a separate wash zone or an intensified wash zone in the wash chamber 124. The spray arm assemblies and sonic cleaner assembly can be of any configuration and location, including additional spray arms or sonic cleaner assemblies.

A second sonic cleaner assembly 172 may be located inside the housing 112 of the dishwasher 110. The sonic cleaner assembly 172 may be fixed to the tub of the wash chamber 124 and configured to provide an additional flow of wash liquid over a sub-portion, or several portions, of the interior of the wash chamber 124 including at least a portion of one of the upper and lower utensil racks 115 and 117. The second sonic cleaner assembly 172 may also provide an additional flow of wash liquid that intersects the first flow of wash liquid provided by the sonic cleaner assembly 152.

The stream of liquid from the second sonic cleaner assembly 172 may be used to provide liquid to areas outside that provided by the spray arm assemblies 132-134, outside the first flow of wash liquid provided by the sonic cleaner assembly 152, In essence, creating multiple zones of sonic cleaning. Each flow can define a separate wash zone and the zones may overlap.

Alternatively, the stream of liquid from the second sonic cleaner assembly 172 may be used to intensify the volume of liquid in one particular area of the wash chamber 124. If the liquid from the second sonic cleaner assembly 172 and the sonic cleaner assembly 152 are directed at the same area in the wash chamber 124 the intensified volume of wash liquid may create a zone of intensified wash performance and be used to improve the wash performance of highly soiled utensils. Thus, the wash liquid from the second sonic cleaner assembly 172 may create a separate wash zone or an intensified wash zone in the wash chamber 124.

It should also be noted that each sonic cleaner assembly can be configured to provide an intensified wash zone and/or a separate wash zone relative to each other and/or relative to the wash zone from any other spray assembly, such as spray arms 132 and 133. For example, one of the sonic cleaner assemblies can be ultrasonic and the other can be megasonic. At least one of them can be more intensified than the wash zone of either spray arms. Thus, it is possible to have several wash zones, each with a different intensity.

The pump assembly 131, sonic cleaner assembly 152, spray arm assemblies 132-134 and supply tube 135 collectively form a liquid recirculation system for liquid within the wash chamber 124. The pump draws liquid from the sump 130 and delivers it to the sonic cleaner assembly 152 and one or more of the spray arm assemblies 132-134 through the supply tube 135, where the liquid is directed back into the wash chamber 124 through the sonic cleaner assembly 152 and the spray arm assemblies 132-134 and drains back to the sump 130 where the process is repeated. While the spray arm assemblies 132 and 133 are illustrated as rotating spray arms and spray arm assembly 134 is illustrated as a fixed spray head, the spray arm assemblies can be of any structure and configuration.

During operation of the dishwasher 110, the sonic cleaner assembly 152 may be employed to direct either ultrasonic or megasonic waveforms via a stream of liquid propagating medium into the wash chamber 124 under the control of the controller 150. When time comes to direct the stream of liquid propagating medium into the wash chamber 124, the controller 150 signals the sonic cleaner assembly 152 and the pump assembly 131 to supply a stream of liquid from the sonic cleaner assembly 152, and any accompanying sprayers or conduits, to the wash chamber 124. The controller 150 sends an alternating voltage signal through the electrical conduit 163 to the transducer 153 that in turn creates the high frequency sound waves. The sonic waves are then propagated via the liquid propagation medium and are directed into the wash chamber. At the same time the controller 150 may control the operation of the pump assembly 131 and heater 136 to implement the selected cycle of the spray arm assemblies 132-134.

The sonic cleaner assemblies may differ from the configuration shown in FIGS. 1-3, such as by inclusion of other valves, conduits, sprayers, liquid propagation medium channels, and the like, to control the flow of the liquid propagation medium through the sonic cleaner assembly and into the wash chamber 24. Further, it is contemplated that the stream projected from the sonic cleaner may take many other shapes. While the invention has been specifically described in connection with certain specific embodiments thereof, it is to be understood that this is by way of illustration and not of limitation, and the scope of the appended claims should be construed as broadly as the prior art will permit.

What is claimed is:

1. A household dishwasher comprising:

a tub defining a wash chamber;

a utensil rack located within the wash chamber;

a rotating spray arm located within the wash chamber and having at least one outlet for spraying wash liquid into the utensil rack to define a first wash zone; and a sonic cleaner located within the wash chamber comprising:

a liquid conducting housing that defines a stream generator configured to direct a stream of liquid from the stream generator into the utensil rack to define a second wash zone; and a transducer located within said housing configured to generate and imbed sound waves in the stream of liquid as the liquid passes in front of the transducer such that said stream of liquid with the sound waves propagated therein is directed from the sonic cleaner into the utensil rack;

wherein at least a portion of the first wash zone intersects with at least a portion of the second wash zone.

2. The household dishwasher according to claim 1, wherein the first wash zone sprays into a sub-portion of the utensil rack.

3. The household dishwasher according to claim 1, wherein the second wash zone sprays into a sub-portion of the utensil rack.

4. The household dishwasher according to claim 1, wherein the second wash zone is an intensified wash zone as compared to the first wash zone for the non-overlapping portions of the wash zones.

5. The household dishwasher according to claim 1, further comprising multiple sonic cleaners within the wash chamber.

6. The household dishwasher according to claim 5, wherein each of the multiple sonic cleaners defines an individual wash zone.

7. The household dishwasher according to claim 1, wherein the stream of liquid is a sheet of liquid.

8. The household dishwasher according to claim 7, wherein the sheet of liquid is fan-shaped.

9. The household dishwasher according to claim 7, wherein the intersection of the sheet of liquid and a utensil being cleaned forms a line of liquid on the utensil.

10. The household dishwasher according to claim 9, wherein the transducer is operated to generate a megasonic waveform.

11. A conveyor dishwasher comprising:

a tub defining a wash chamber;

a utensil holder in the form of a conveyor belt with utensil rack located at least partially within the wash chamber;

a first sonic cleaner located within the wash chamber above the utensil rack comprising:

a liquid conducting housing that defines a stream generator configured to direct a first stream of liquid from the stream generator into the utensil rack to define a first wash zone; and a transducer located within said housing configured to generate and imbed sound waves in the stream of liquid as the liquid passes in front of the transducer such that said stream of liquid with the sound waves propagated therein is directed from the sonic cleaner into the utensil rack;

a second sonic cleaner located within the wash chamber below the utensil rack comprising:

a liquid conducting housing that defines a stream generator configured to direct a second stream of liquid from the stream generator into the utensil rack to define a second wash zone; and a transducer located within said housing configured to generate and imbed sound waves in the stream of liquid as the liquid passes in front of the transducer such that said stream of liquid with the sound waves propagated therein is directed from the sonic cleaner into the utensil rack;

wherein at least a portion of the first wash zone intersects with at least a portion of the second wash zone.

12. The household dishwasher according to claim 11, wherein at least one of the first and second streams of liquid is a sheet of liquid.

13. The household dishwasher according to claim 12, wherein the intersection of the sheet of liquid and a utensil being cleaned forms a line of liquid on the utensil.

* * * * *